US011505356B2

(12) United States Patent
Van Rijsewijk

(10) Patent No.: US 11,505,356 B2
(45) Date of Patent: Nov. 22, 2022

(54) DEVICE AND SYSTEM FOR ARRANGING FOLDS IN FOIL MATERIAL

(71) Applicant: Fuji Seal International, Inc., Osaka (JP)

(72) Inventor: Lucas Van Rijsewijk, Boxtel (NL)

(73) Assignee: Fuji Seal International, Inc., Osaka (JP)

( * ) Notice: Subject to any disclaimer, the term of this patent is extended or adjusted under 35 U.S.C. 154(b) by 148 days.

(21) Appl. No.: 16/340,514

(22) PCT Filed: Oct. 12, 2017

(86) PCT No.: PCT/NL2017/050669
§ 371 (c)(1),
(2) Date: Apr. 9, 2019

(87) PCT Pub. No.: WO2018/070872
PCT Pub. Date: Apr. 19, 2018

(65) Prior Publication Data

US 2019/0263553 A1 Aug. 29, 2019

(30) Foreign Application Priority Data

Oct. 12, 2016 (NL) ..... 2017613
Jan. 4, 2017 (NL) ..... 2018117

(51) Int. Cl.
*B65B 9/14* (2006.01)
*B65C 3/06* (2006.01)
*B65C 9/00* (2006.01)

(52) U.S. Cl.
CPC ..... *B65C 3/065* (2013.01); *B65C 2009/005* (2013.01)

(58) Field of Classification Search
CPC ..... B65B 9/14; B65C 3/065
(Continued)

(56) References Cited

U.S. PATENT DOCUMENTS 3,940,834 A * 3/1976 Lajovic ..... B21D 51/36 29/33 E
4,514,966 A * 5/1985 Konstantin ..... B65C 3/065 53/291

(Continued)

FOREIGN PATENT DOCUMENTS

JP 2004-026244 A 1/2004
JP 2006-076629 A 3/2006

(Continued)

OTHER PUBLICATIONS

International Search Report and Written Opinion dated Jan. 8, 2018 for Application No. PCT/NL2017/050669, 11 pgs.

(Continued)

*Primary Examiner* — Thanh K Truong
*Assistant Examiner* — Patrick B Fry
(74) *Attorney, Agent, or Firm* — Frost Brown Todd LLC

(57) ABSTRACT

A device is provided for arranging folds in a strip of flattened tubular shrink foil material in a container sleeving system for applying tubular shrink foil material around containers. The device includes a guiding element having an upstream guiding element part formed by a first flat plate extending in a first plane, a downstream guiding element part formed by a second flat plate extending in a second plane rotated with respect to the first plane, and an intermediate guiding element connected to or integrally formed with the upstream and downstream guiding elements and shaped so as to smoothly guide the flattened tubular shrink foil material moving over the first flat plate towards the second flat plate. The device also includes pressure rollers arranged to press at least one additional fold into the tubular shrink foil material.

4 Claims, 10 Drawing Sheets

(58) Field of Classification Search
USPC ..... 53/137.2, 556; 156/198, 200
See application file for complete search history.

(56) References Cited

U.S. PATENT DOCUMENTS 4,693,059 A * 9/1987 O'Donnell ..... B65B 9/14 493/309
4,922,683 A * 5/1990 Connolly ..... B65B 9/14 53/291
5,024,049 A * 6/1991 Strub ..... B67B 5/036 53/291
5,086,682 A * 2/1992 Strub ..... B26D 1/045 53/292
5,433,057 A 7/1995 Lerner et al.
5,466,210 A * 11/1995 Wilcox ..... B65B 9/14 493/309
5,566,527 A * 10/1996 Drewitz ..... B65B 7/2885 53/295
5,992,492 A * 11/1999 Huang ..... B29C 63/426 156/499
6,523,331 B1 2/2003 Fresnel
9,199,750 B2 * 12/2015 Sawamura ..... B65C 3/065
9,278,773 B2 * 3/2016 Arima ..... B29C 63/423
2004/0221962 A1 * 11/2004 Haung ..... B65B 9/14 156/538
2013/0061559 A1 * 3/2013 Van Rijsewijk ..... B65B 9/14 53/381.5

FOREIGN PATENT DOCUMENTS

JP 2006076635 A * 3/2006 ..... B65C 3/065
JP 2008-155928 A 7/2008
JP 4530772 B2 8/2010
WO WO 2011/031160 A1 3/2011

OTHER PUBLICATIONS

Japanese Notification of Reasons for Refusal dated Sep. 10, 2021 for application No. 2019 517804, 16 pages.

* cited by examiner

DEVICE AND SYSTEM FOR ARRANGING FOLDS IN FOIL MATERIAL

PRIORITY

This application claims priority to and benefit of PCT Application PCT/NL2017/050669, filed Oct. 12, 2017, which claims priority to and benefit of NL Application 2018117, filed Jan. 4, 2017, and NL Application 2017613, filed Oct. 12, 2016, the contents of which are incorporated by reference in their entirety for all purposes.

TECHNICAL FIELD

The present application relates to a device and system for arranging at least one additional fold in a strip of flattened tubular shrink foil material. The present application also relates to a container sleeving system for sleeving a plurality of containers comprising such device and system for arranging at least one additional fold in a strip of flattened tubular shrink foil material.

BACKGROUND

A container sleeving system for sleeving a plurality of containers by arranging on the containers respective sleeves made from a strip of flattened tubular shrink foil material is disclosed in, for example, the international publication WO 2011031160 A. The known container sleeving system is aimed at arranging sleeves (labels) around containers, for instance food containers, bottles, bowls, holders, etc. in a fast and reliable manner by feeding a continuous strip of flattened tubular foil material wound around a foil supply reel towards a spreading element (sometimes referred to as the mandrel), transporting the foil material along the outer surface of the spreading element by a foil drive mechanism so as to open the foil material, cutting the foil material to form sleeves and discharging the sleeves from the spreading element towards a container passing by the spreading element while being transported on a conveyor. The sleeve is applied around the container and the container with the sleeve is transported to an oven in order to heat shrink the sleeve around the container.

As mentioned above tubular foil material is supplied in a flattened shape and is opened by guiding the flattened foil material along the spreading element. The factory producing the strip of flattened foil material to be used in the container sleeving system usually has two folds (herein referred to as the "factory folds"). An example of a strip of flattened tubular foil material (slightly opened for illustration purposes only) typically provided by a factory is shown in FIG. 1. The figure shows a cross-section of a strip 1 of flattened tubular foil material in which two folds 2, 2' have been preformed. When this strip 1 of foil material is opened by the spreading element, the foil material in takes a generally circular or oval shape in cross-section making the foil material especially suitable for being shot towards and arranged on a container having a similar circular or oval shape in cross-section.

However, in case the container has a different shape, for instance a generally rectangular shape in cross-section, for example a washing powder container, the size in cross-section of the two fold tubular foil material should be excessively large to be able to be arranged around the container.

It is known to create additional folds in the foil material to be able to give the foil material once it has been discharged from the spreading element a square shape in cross-section. This may make the resulting tubular foil material suitable for being arranged around containers having a generally square cross-section. However, in case the container has a generally rectangular shape, for example a washing powder container, the shape of the foil material does not correspond to the shape of the container and hence the proper application of the foil material (sleeve) around the container may still be difficult. A further advantage of the additional fold is the increased orientation accuracy of the foil material to be applied to the container JP 4530772 B2 discloses an apparatus comprising a folding back guide (20) able to spread the foil material moved therealong in a different plane. To this end the folding back guide has an upstream side guide (20*a*) and a downstream side guide (20*b*) along which a strip of tubular foil material can be guided. The apparatus also comprises two sets of rollers, wherein the downstream rollers (42*a*) are arranged to provide additional folds into the foil material. At the ends at which the downstream side guide and upstream side guide abut, the side guides have a circular cross-section.

The downstream side guide and upstream side guides are rotatable relative to each other along an imaginary longitudinal axis. This allows the positions of the additional folds to be set by a suitable rotation of the downstream side guide relative to the upstream side guide. A disadvantage of the known apparatus is that the foil material travelling along the side guides is first opened from the flattened state into an opened state and then again flattened and that the circumference of the side guides varies in the travel direction of the foil material which often results in wrinkles or similar artefacts. Another cause for such wrinkles and similar artefacts is that the travel distance of the foil material, i.e. the distance each part along the circumference of a sleeve travels along the outer surface of the side guides, may vary over the circumference. The known apparatus also creates tension in the foil material which may cause handling problems downstream of the apparatus. Furthermore, the known apparatus is relatively complex and prone to wear.

SUMMARY

It is an object of the present invention to provide a device and system for arranging at least one additional fold in a strip of flattened tubular shrink foil material wherein at least one of the above-mentioned drawbacks has been removed or at least reduced.

It is also an object of the present invention to provide a device and system for arranging one or more folds at one or more selectable positions in a strip of flattened tubular shrink foil material.

It is a further object of the present invention to provide a device and system for arranging at least one additional fold in a strip of flattened tubular shrink foil so as to create a sleeve of an arbitrarily-shaped rectangular sleeve for sleeving a container having a corresponding cross-sectional shape.

It is a further object of the present invention to provide a container sleeving system comprising an improved device and/or system for arranging additional folds in the strip of flattened tubular shrink foil material.

According to a first aspect at least one of the objects is achieved in device for arranging at least one additional fold in a strip of flattened tubular shrink foil material in a container sleeving system for applying tubular shrink foil material around containers, the device comprising a guiding element having a front side and a back side and configured to guide therealong the strip of flattened tubular shrink foil material moving in axial direction along the guiding element, wherein the guiding element comprises:

an upstream guiding element part formed by a first flat plate extending in a first plane;

a downstream guiding element part formed by a second flat plate part extending in a second plane rotated with respect to the first plane; and a generally wedge-shaped intermediate guiding element part connected to or integrally formed with the upstream and downstream guiding element parts and shaped so as to smoothly guide the flattened tubular shrink foil material moving over the first flat plate towards the second flat plate;

at least one pair of pressure rollers arranged on either side of the downstream guiding element part and configured to press at least one additional fold into the tubular shrink foil material.

The strip can remain in its flattened condition during the creation of additional folds and/or during the removal of existing folds.

In an exemplary embodiment the lateral edges of the upstream guiding element part are configured to guide therealong the original folds of the flattened tubular shrink foil material, the lateral edges of the downstream guiding element part are configured to form additional folds in the flattened tubular shrink foil material, the additional folds being located at positions different from the positions of the original folds and the pressure rollers are configured to press on both sides against the flattened tubular shrink foil material at the locations of the one or more additional folds.

In an exemplary embodiment at least one of lateral edges of the downstream guiding element part has an opening arranged to receive the pressure rollers for pressing on the strip of tubular shrink foil material to provide the at least one additional fold in the tubular shrink foil material.

In an exemplary embodiment the circumference of the upstream guiding element part is essentially the same as the circumference of the intermediate guiding element part and/or wherein the circumference of the intermediate guiding element part is essentially the same as the circumference of the downstream guiding element part.

In an exemplary embodiment the circumference in cross-section is constant over the entire height of the guiding element.

In an exemplary embodiment the guiding element is shaped so that the travel paths of the strip of flattened tubular shrink foil material travelling in downstream direction over the outer surfaces of the guiding element are equal at all positions along the circumference of the guiding element.

In an exemplary embodiment the cross-sections of the upstream and downstream guiding element parts are rectangular and/or wherein the cross-section of the upstream guiding element part is essentially the same as the cross-section of the downstream guiding element part.

In an exemplary embodiment both opposite lateral edges of the downstream guiding element part have at least one opening arranged to receive a respective pair of pressure rollers, the pressure rollers being configured to press a plurality of additional folds at either lateral edge of the strip of tubular shrink foil material.

In an exemplary embodiment the device comprises a pair of pressing rollers arranged so as to at least partly remove one or more existing folds already present in the supplied foil material. The pressing rollers for removing an existing fold may be combined with the pressure rollers for arranging an additional foil in the foil material.

In exemplary embodiments the outer surfaces of the upstream guiding element part are essentially flush with the outer surfaces of the intermediate guiding element part and/or the outer surfaces of the intermediate guiding element part are essentially flush with the outer surfaces of the downstream guiding element part.

In an exemplary embodiment the device comprises positioning rollers arranged in the downstream guiding element part and/or the intermediate guiding element part. The positioning rollers may be configured to cooperate with associated positioning rollers attached to a frame.

In an exemplary embodiment the device comprises a foil material orientation unit configured to receive the strip of foil material from the downstream guiding element part, change the orientation of the strip and discharging the strip with a changed orientation.

In an exemplary embodiment the strip of flattened tubular foil material is a continuous web of tubular shrink foil material to be cut into individual sleeves or pre-cut individual sleeves made of tubular shrink foil material.

In an exemplary embodiment the intermediate guiding element part is dimensioned to fit the tubular shrink foil material of a given width.

In an exemplary embodiment the intermediate guiding element part is shaped so as to allow the cross-sectional shape of the strip of tubular shrink foil material moving along the guiding element part to smoothly change from a first shape at the upstream guiding element part into a second shape at the downstream guiding element part.

In an exemplary embodiment the downstream guiding element part is essentially axially aligned with the upstream guiding element part.

In an exemplary embodiment the cross-sectional shape and dimensions of the upstream guiding element part and the downstream guiding element are the same.

In an exemplary embodiment the downstream guiding element part is arranged relative to the upstream guiding element part at an orientation rotated along an imaginary axial axis of symmetry.

In an exemplary embodiment the plane of the downstream guiding element part extends at an angle ($\alpha$) relative to the plane of the upstream guiding element part, wherein the angle ranges between 1 and 90 degrees, preferably between 5 and 45 degrees.

According to another aspect a system for arranging at least one additional fold in a strip of flattened tubular shrink foil material is provided, the system comprising a device as defined herein and a drive unit to move the strip in axial direction along the guiding element. The system may comprise a frame and a roller support attached to the frame, wherein the orientation of the roller support is configured to be set depending on the orientation of the downstream guiding element part.

In an exemplary embodiment the guiding element is removably attached to the frame.

According to another aspect a container sleeving system for arranging sleeves of tubular shrink foil material around containers conveyed on a conveyor is provided. The container sleeving system comprises:

a device for arranging at least one additional fold in a strip of flattened tubular shrink foil material as claimed in any of the preceding claims;

a foil supply for supplying flattened tubular shrink foil material to the device;

a spreading unit configured to receive the flattened tubular shrink foil material in which at least one additional fold has been arranged and spreading open the tubular shrink foil material;

a discharge unit for moving the flattened tubular shrink foil material along the spreading unit and discharging the flattened tubular shrink foil material towards one or more containers on the conveyor.

In an exemplary embodiment the container sleeving system comprises a cutting unit for cutting the strip of foil material into sleeves of predetermined length.

BRIEF DESCRIPTION OF THE DRAWINGS

Further characteristics of the present disclosure will be elucidated in the accompanying description of various exemplary embodiments thereof, examples of which are illustrated in the accompanying drawings wherein like reference numerals refer to the like elements throughout. The figures show.

Figure 1:
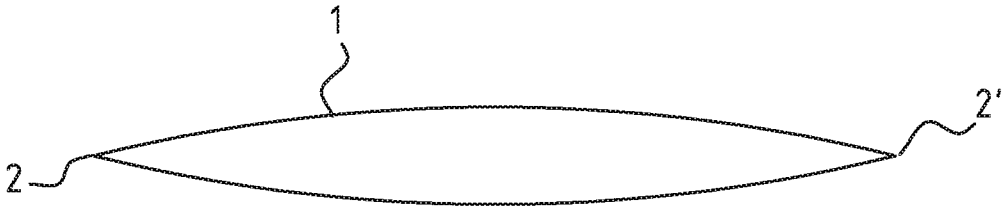
FIG. 1 depicts a cross-sectional view of a prior art strip of flattened tubular foil material that is slightly opened for illustration purposes, typically provided by a factory.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Unless defined otherwise, all technical terms used herein have the same meaning as commonly understood by one of ordinary skill in the art to which this invention belongs. Still, certain elements are defined below for the sake of clarity and ease of reference. Furthermore it is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual exemplary embodiments described and illustrated herein has discrete components and features which may be readily separated from or combined with the features of any of the other several exemplary embodiments without departing from the scope of the present invention. Any recited method can be carried out in the order of events recited or in any other order which is logically possible.

Figure 4:
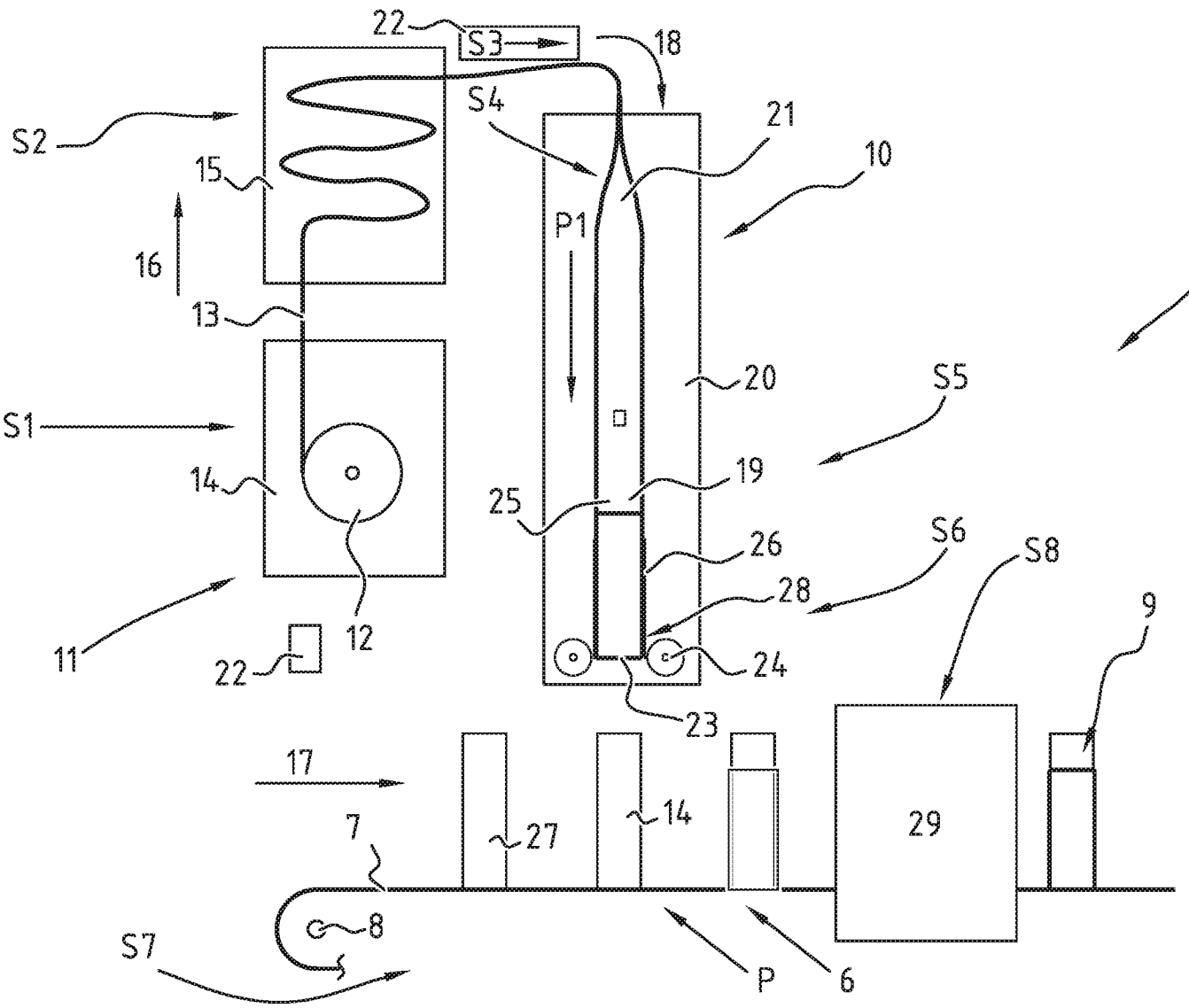
FIG. 4 depicts a schematic view of a container sleeving system for use with the flattened tubular foil material of FIGS. 2 and 3, according to an exemplary embodiment of the present disclosure.
Figure 5:
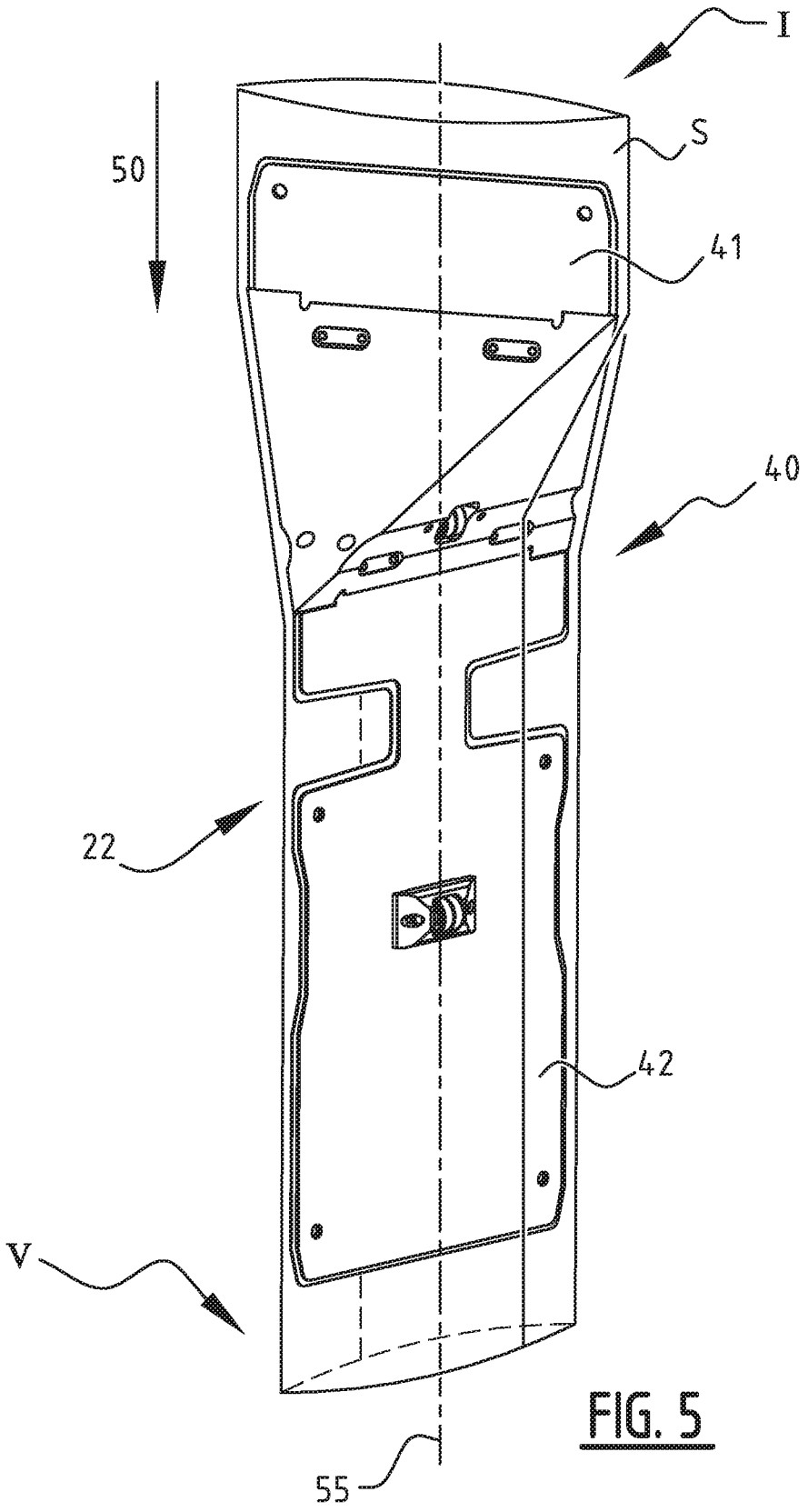
FIG. 5 depicts a schematic view in perspective of an exemplary embodiment of a guiding element of a fold arranging device for use with the container sleeving system of FIG. 4, along which a strip of flattened tubular foil material is being guided.
Figure 6:
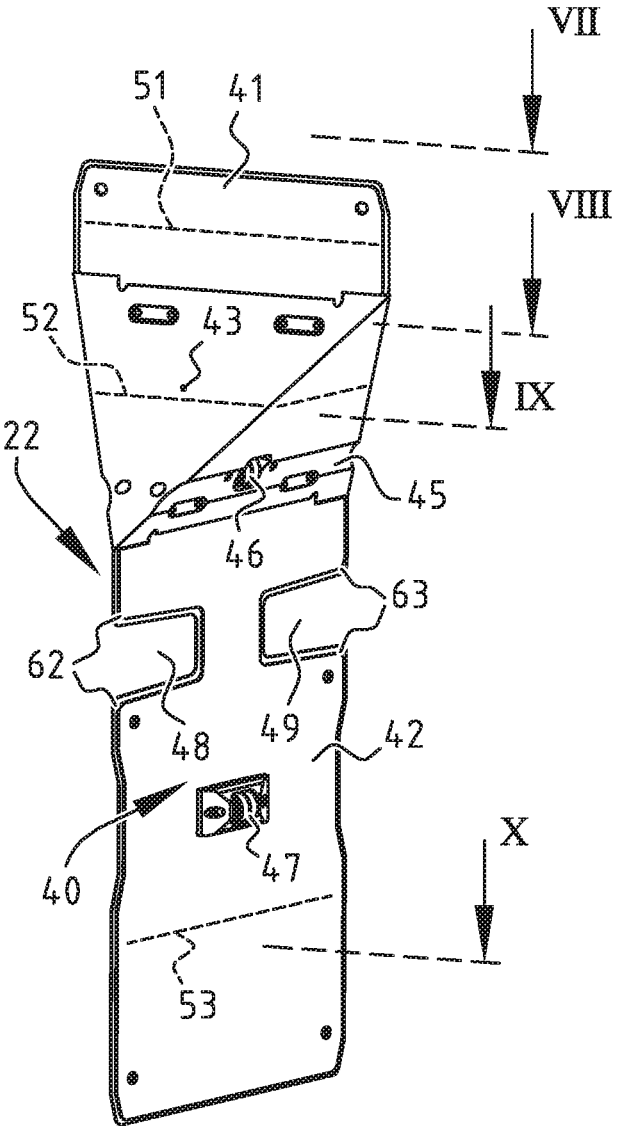
FIG. 6 depicts a schematic view of the guiding element of FIG. 5, without the strip of flattened tubular foil material.
Figure 7:
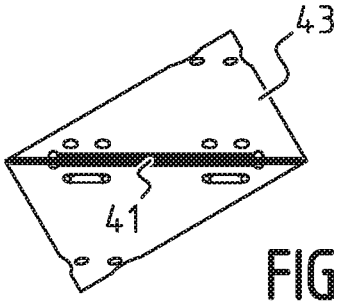
FIG. 7 depicts a cross-sectional view of the guiding element of FIG. 6, taken along line VII of FIG. 6.
Figure 8:
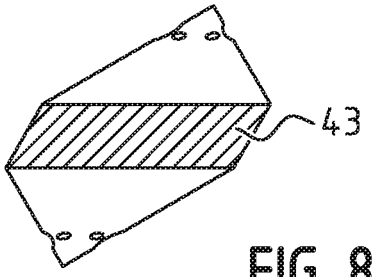
FIG. 8 depicts a cross-sectional view of the guiding element of FIG. 6, taken along line VIII of FIG. 6.
Figure 9:
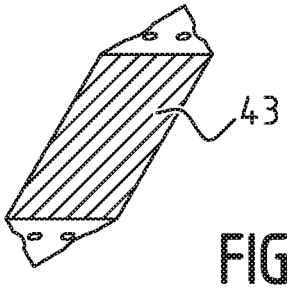
FIG. 9 depicts a cross-sectional view of the guiding element of FIG. 6, taken along line IX of FIG. 6.

FIG. 4 schematically shows an exemplary embodiment of a container sleeving system 5 for sleeving (labeling) containers. The sleeving system 5 comprises a conveyor 6 (only partly shown in the figure) for conveying one or more parallel rows of containers 27, for instance washing powder containers having a generally rectangular cross-section, in a direction 17 along a sleeving position (P) at which sleeves are arranged around the containers. Exemplary embodiments of the conveyor may comprise an endless transport belt 7 to be conveyed by suitable wheels 8 in the direction 17. However, other types of conveyors may be employed as well. In fact, conveyor 6 may be any type of conveyor capable of transporting an array of containers along the sleeving position.

In the exemplary embodiment shown in FIG. 4 the containers 27 are arranged on top of the belt 7. The conveyor 6 may be configured to transport the containers 27 in a discontinuous manner (i.e. intermittently). In preferred exemplary embodiments, however, the conveyor is arranged to transport the containers in a continuous manner (i.e. non-intermittently). In these exemplary embodiments the operation of arranging of sleeves around the container is performed on the fly and essentially without interrupting the transport of the containers.

FIG. 4 also shows a stationary sleeving device 10 arranged above the sleeving position (P) and configured to arrange sleeves of foil material around containers transported by the conveyor 6. Sleeves are formed by cutting a continuous strip of tubular foil material, i.e. foil material configured as a flattened tube or envelope, at a suitable length. In the present application "sleeve" may be used as an indication for the individual pieces of foil that are arranged around products, but may equally well refer to the foil or strip forming a flattened or opened tube before it is cut.

Preferably the foil material is of a type that shrinks when it is subjected to a predefined physical phenomenon, for instance when it is subjected to heat. As explained later, the heat shrinkable foil may be applied around the container and then attached by heat-shrinking the foil onto the container.

FIG. 4 further shows a sleeve supply 11 for supplying a continuous strip of tubular flattened foil material 13 to the sleeving device 10. The sleeve supply 11 comprises a foil stock 14 in which one or more of supply reels 12 are arranged. On each of the supply reels 12 a continuous strip of tubular flattened foil material 13 has been wound. The strip of foil material can be transported towards the sleeving device 10 (direction 16) by any suitable means, for instance several sets of wheels or rollers (not specifically shown in the figures). The foil material of a selected one of the supply reels 12 is transported (S1) towards a foil buffer 15. The foil buffer is arranged to buffer (S2) the supplied foil material to allow for variations in operating speed of the supply without the need to interrupt the sleeving process. In an exemplary embodiment the foil stock 14 comprises a splicer (not shown) which is configured to connect a new strip of foil material from a further roll to the end of strip of foil material of an old reel to allow for a continuous feed of foil material to the sleeving device 10. Due to the splicer and the foil buffer 15 the supply of foil material to the sleeving device 10 can be essentially continuously (i.e. in an uninterrupted manner).

The supplied foil material 13, which has a flattened tubular shape, is caused to move (direction 18) along a fold arranging device 22 (only schematically shown in FIG. 4) that will create (S3) in the foil material 13 one or more additional folds (i.e. additional to the factory folds already present in the supplied foil material). The flattened tubular foil material 13 leaving the fold arranging device 22 then reaches a spreading element 19, herein also referred to as the "mandrel", of the sleeving device 10. In the exemplary embodiment shown in FIG. 4 the spreading element 19 is configured to first spread (S4) the flattened foil material to an "open" position and then to cut the foil material to a specific length so that foil material forms consecutive sleeves. In other exemplary embodiments the flattened foil material is first cut to a specific length to provide a sleeve and then advanced along the spreading element to open the sleeve. In each case a sleeve is sized to be arranged around the container 27 passing below the spreading unit 19. Securing the sleeve to the container may involve gluing or, preferably, a heat shrinking process.

As described above the sleeving device 10 comprises a spreading element 19 (which may be comprised of a plurality of parts). The spreading element 19 is suspended from a stationary frame 20 and is configured for spreading the strip of foil (which initially has a flattened tubular form) to an open position. To this end the spreading element 19 is provided with a spear or tip 21 shaped to open the foil 13 delivered as a flat envelop of foil material. For instance, the spear 21 may have a substantially flat cross section at the upstream end and more or less circular cross section at the downstream end thereof to bring the foil material to the desired tubular envelope or sleeve shape.

Sleeving device 10 further comprises a cutting unit 25 for cutting (S5) of sleeves from the opened foil material 13. The foil material may be guided past the cutting means unit for cutting the foil material at certain intervals so as to obtain individual sleeve-like foil envelopes or sleeves 26 of a suitable length. More specifically, the tubular foil material may be advanced over the spreading element and then stopped at a predetermined position such that the cutting device 25 may cut the foil material to realize a sleeve 26 having the required cutting length 61.

The sleeving device 10 also comprises a sleeve discharge unit 28, for instance comprising a pair of opposing inner guide wheels mounted at the distal end 29 of the spreading element 19 and a pair of outer drive wheels (which may be driven by a suitable electric motor, not shown in the figures) mounted at the frame 20, for shooting (S6) sleeves 26 cut from the strip of foil material towards the containers passing by the sleeving device. If the timing of discharging is correct and the containers are more or less aligned with the spreading element 19 the sleeves may be correctly arranged around the containers.

Once a sleeve 26 has been formed by the cutting unit 25, ejected (S6) towards the container 27 by the discharge unit 28 and arranged around the container by having the sleeve slide downwardly along the top end 14 of the container 27, the combination of sleeve 26 and container 27 is conveyed (S7) further in direction 17 by conveyor 6. Conveyor 6 transports the sleeved containers further downstream to a shrink unit 29 for attaching the sleeves around the containers by shrinking the same. For instance, the shrink unit 29 may be a heated steam oven wherein the sleeve 26 may be heat shrunk (S8) so that the sleeve 26 is permanently attached to the container 27, providing a labeled container 9. In a subsequent step a drying process may be applied. FIG. 4 also shows a controller 22 that is configured to control at least one of the movement of the foil material over the fold arranging device 22, the movement of the foil material over the spreading element 19, the cutting of the foil material by the cutting unit 25, the discharge of the cut foil material by the discharge unit 28, the transport by the conveyor 6 and the shrink-operation by the shrink unit 29.

Figure 2:
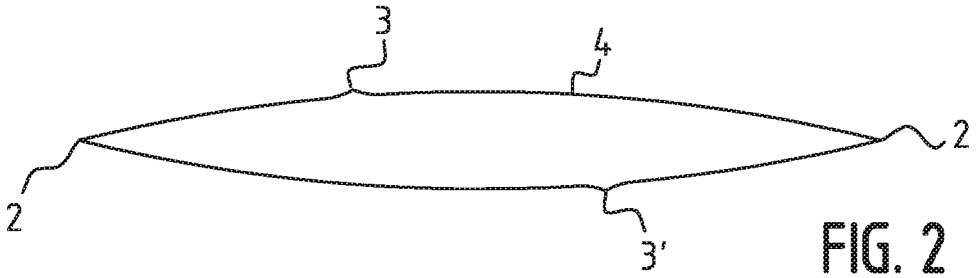
FIG. 2 depicts a cross-sectional view of a strip of flattened tubular foil material in a flattened shape, in which two original (factory) folds and two additional folds have been made, according to an exemplary embodiment of the present disclosure.
Figure 3:
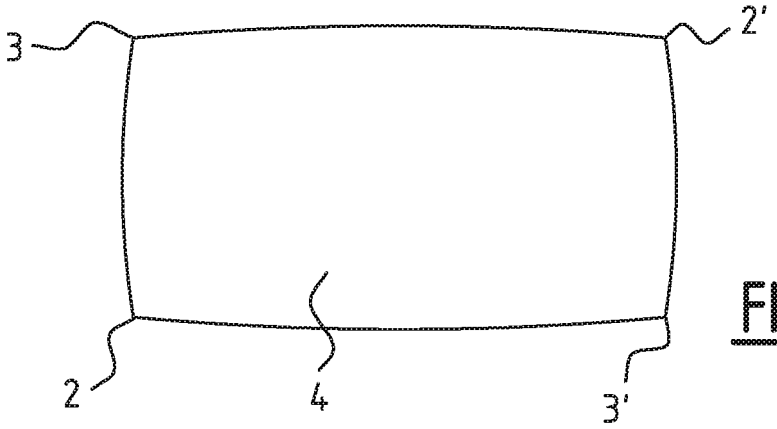
FIG. 3 depicts a cross-sectional view of the strip of flattened tubular foil material of FIG. 2, in which two original (factory) folds and two additional folds have been made, after it has been opened by a spreading element of a containers sleeving system.

FIGS. 2 and 3 show an example of a strip 4 of flattened tubular foil material in which two preformed factory folds 2, 2' (i.e. folds that are present in the foil material supplied to the container sleeving system) and two additional folds 3, 3' have been created using an exemplary embodiment of the fold arranging device 22. FIG. 2 shows the situation just after the foil material has left the downstream guiding element part and before it has reached the spreading element 19 of the container sleeving system 5. FIG. 3 shows the situation when the foil material has been opened, just after the foil material (which in the meantime has been cut into individual sleeves) has left the spreading element 19 and is discharged towards the container. The figures clearly demonstrate that arranging two additional folds 3, 3' at different positions than the original folds 2, 2' make it possible to create a generally rectangular sleeve of foil material that is particularly well-suited for being arranged around a generally rectangular container.

Referring to FIGS. 5-10 an example of a fold arranging device 22 used in the container sleeving system 5 of FIG. 4 is discussed. The fold arranging device 22 comprises a guiding element 40 configured so as to guiding along its exterior surface the moving foil material, the movement of the foil material being driven by a drive unit 64. The fold arranging device 22 further comprises at least one pair of pressure rollers configured to press one or more additional folds in the foil material (and/or to remove an existing fold by pressing the same), as will be discussed hereafter.

The guiding element 40 has a front side and a back side and is configured to guide therealong a strip (S, FIG. 5) of flattened tubular shrink foil material in a feeding direction 50. The guiding element 40 has an upstream guiding element part 41 formed by a first flat plate extending in a first plane (FIG. 7) and a downstream guiding element part 42 formed by a second flat plate extending in a second plane (FIG. 10), the second plane having being rotated with respect to the first plane (relative to an imaginary central longitudinal axis 55). In this arrangement the downstream guiding element part may be essentially axially aligned with the upstream guiding element part. More specifically, the orientation of the downstream guiding element part may be an orientation rotated around the imaginary central longitudinal axis 55 which may be central to both the upper guiding element part and the lower guiding element part and therefore constitutes an axis of symmetry of both guiding element parts. Furthermore, the angle ($\alpha$) (FIG. 10) between the first and second plane of respectively the upstream guiding element part 41 and downstream guiding element part 42 may vary, for instance in a range between 1 and 90 degrees, preferably between 5 and 45 degrees. The guiding element 40 further comprises an intermediate guiding element part 43 that is arranged between the upstream guiding element part 41 and the downstream guiding element part 42. The intermediate guiding element part 43 may a separate part connected at one end to the upstream guiding element part 41 and at the opposite end to the downstream guiding element part 42.

In other exemplary embodiments the intermediate guiding element part is integrally formed between the upstream and downstream guiding element parts 41, 42. The intermediate guiding element part 43 in the exemplary embodiments shown in FIGS. 5-10 is generally wedge-shaped. More specifically, in the particular embodiment shown in these figures, the intermediate guiding element part 43 is a tetrahedron or a solid triangular wedge. Other shapes are possible as well. In any case the wedge should be shaped so as to allow smooth guidance of the flattened tubular shrink foil material moving over the upstream guiding element part 41 towards the downstream guiding element part 42.

The guiding element may be provided with a positioning unit (only partly shown in the figures) including a first set of positioning rollers 46 provided in a transversal groove 45 in the outer surface of the intermediate guiding element part 43 and a second set of positioning rollers 47 provided in the outer surface of the downstream guiding element part 42. The positioning unit further comprises two sets of driven or non-driven further positioning wheels (not shown) that are arranged to press against the first and second set of positioning rollers with the foil arranged between the positioning rollers and the further positioning rollers so that the further positioning rollers may engage the tubular foil material. In embodiments wherein the further positioning rollers are driven by a drive unit 64, the rollers may assist in moving the foil material in axial direction 50 from the upstream guiding element part 41, along the intermediate guiding element part 43 and the downstream guiding element part 42 in the direction of the sleeving device 10.

Figure 12:
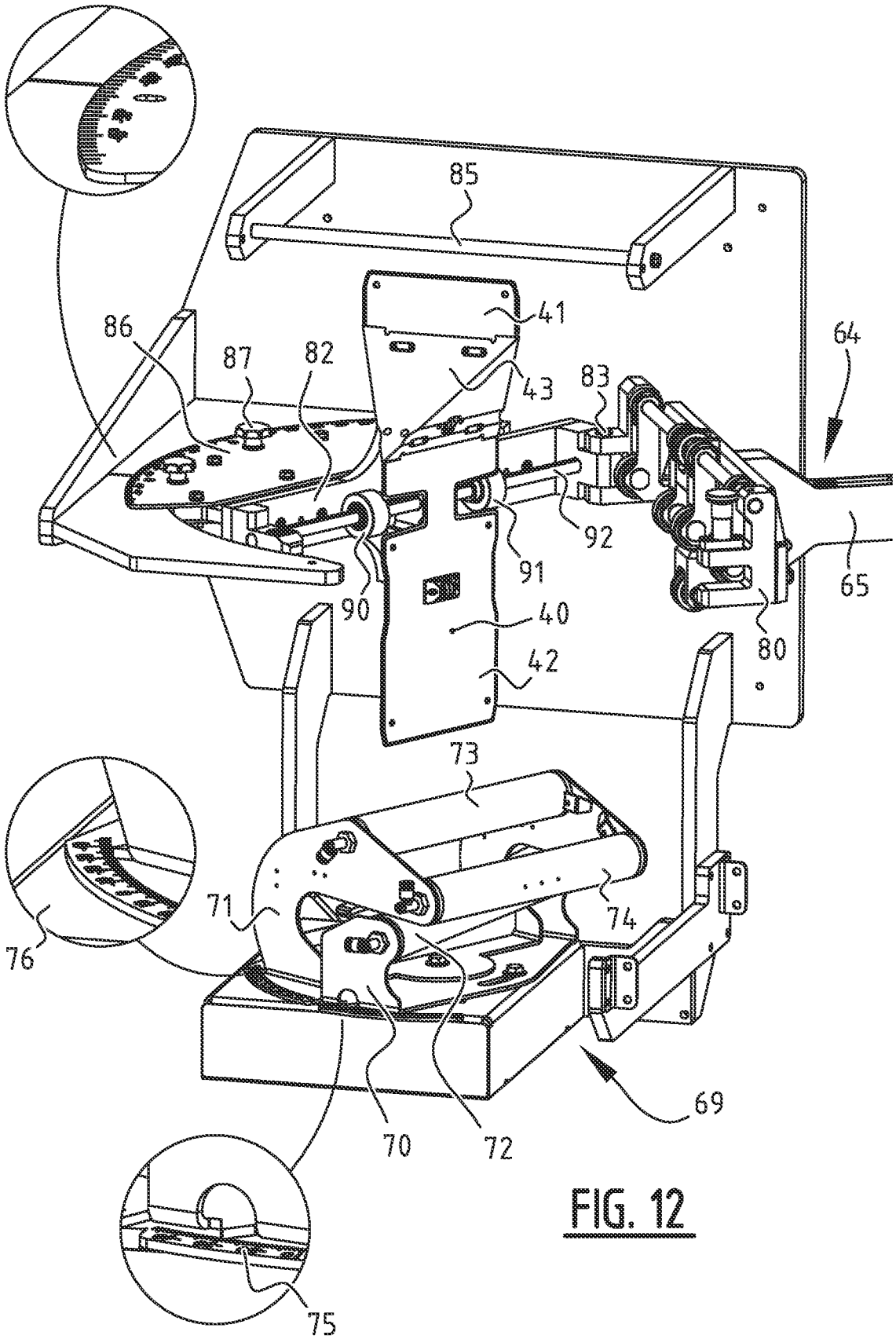
FIG. 12 depicts a front perspective view of the fold arranging system of FIG. 11 in an open position.
Figure 13:
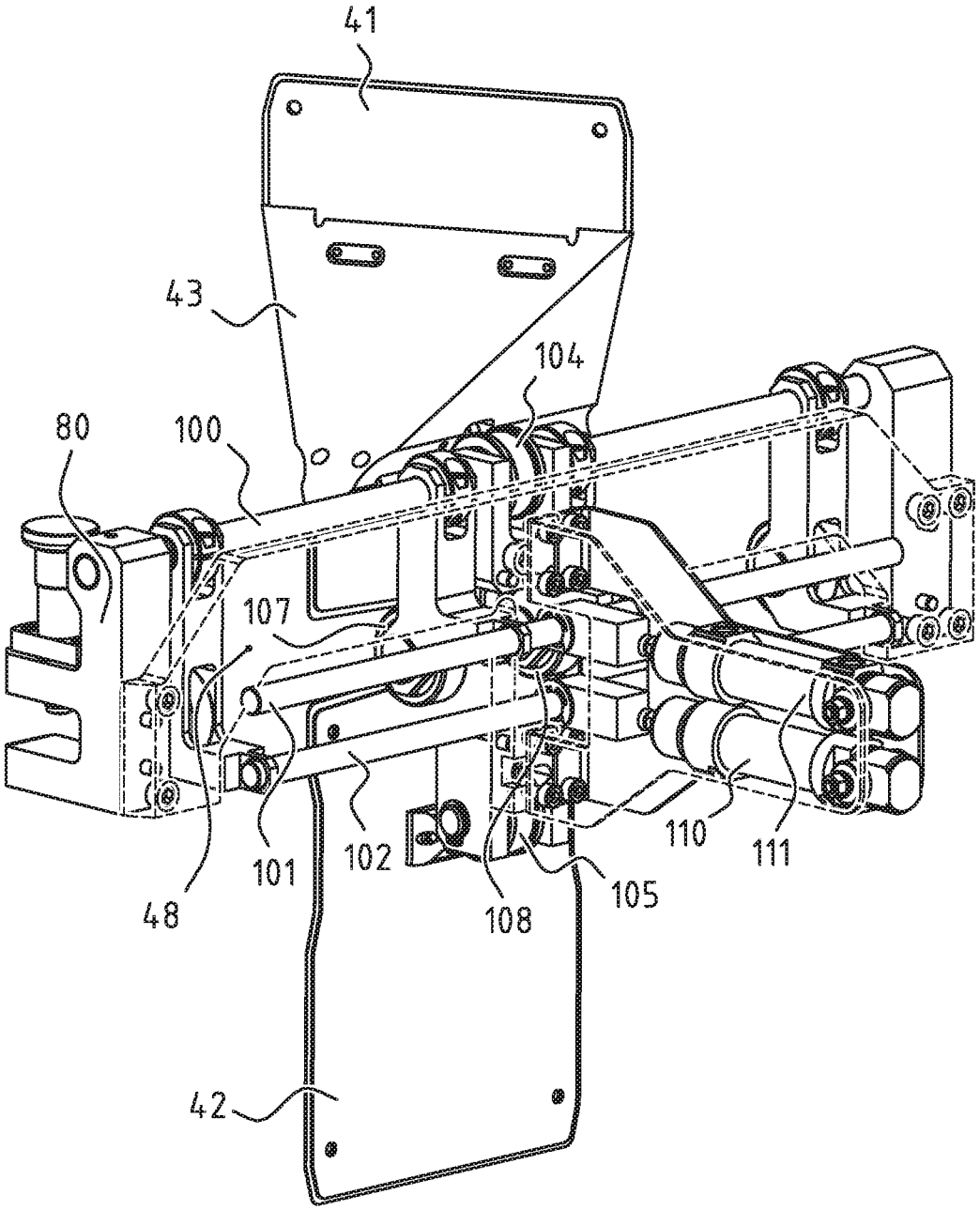
FIG. 13 depicts a front perspective view of the guiding element and pressure rollers of the fold arranging system of FIG. 11.
Figure 14:
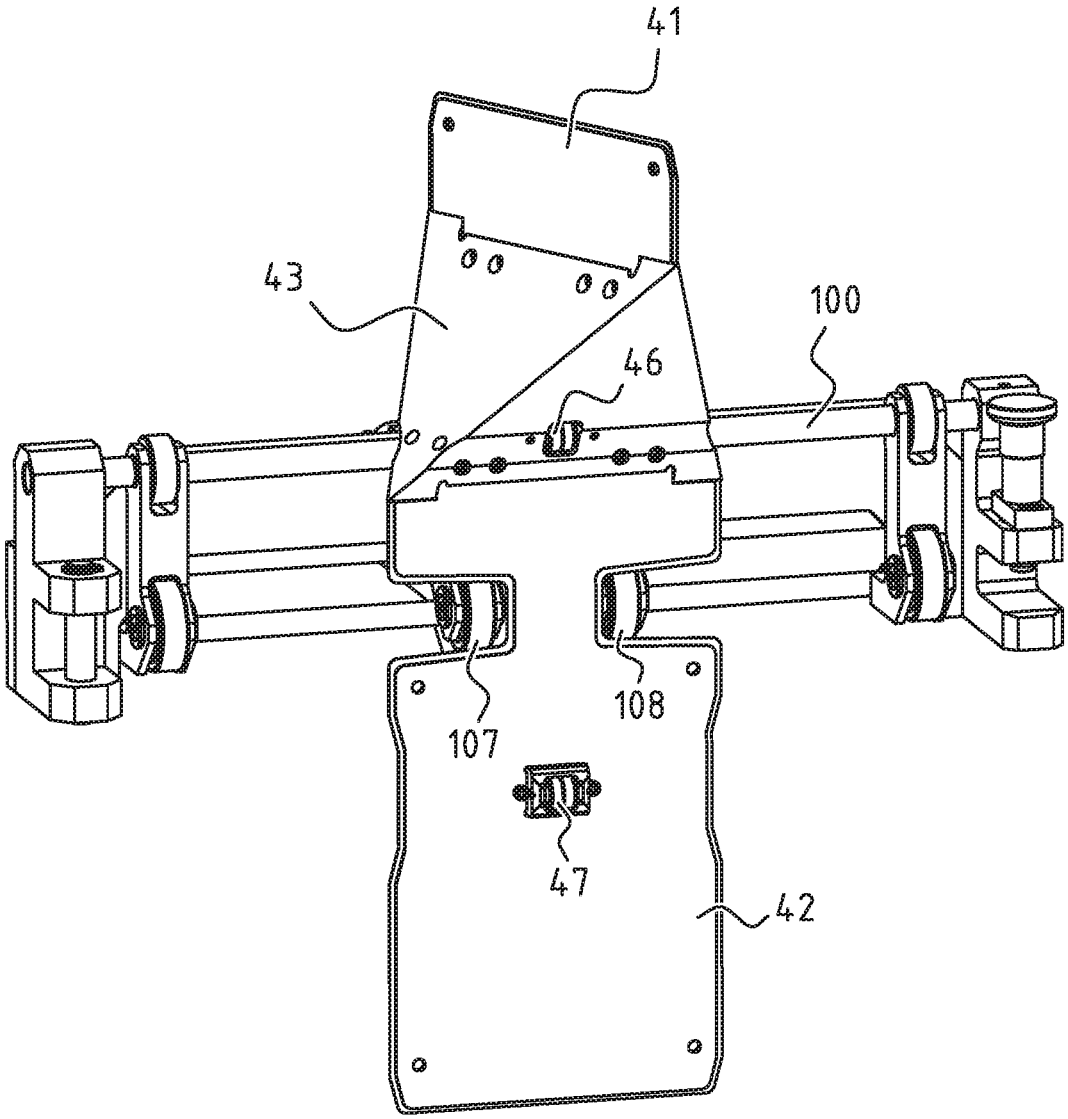
FIG. 14 depicts a rear perspective view of the guiding element and pressure rollers of the FIG. 13.
Figure 15:
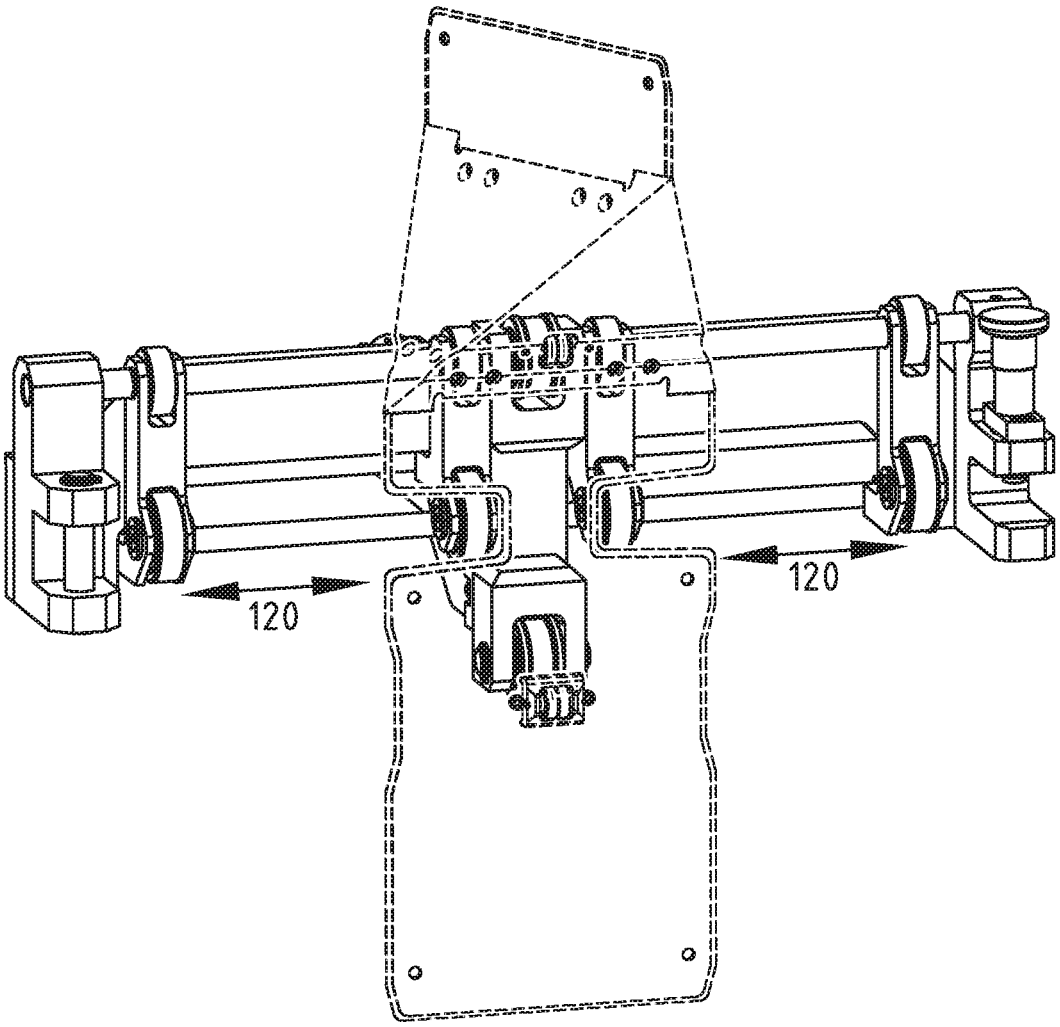
FIG. 15 depicts a rear perspective view of the guiding element and pressure rollers of the FIG. 14, showing the guiding element in broken lines.
Figure 16:
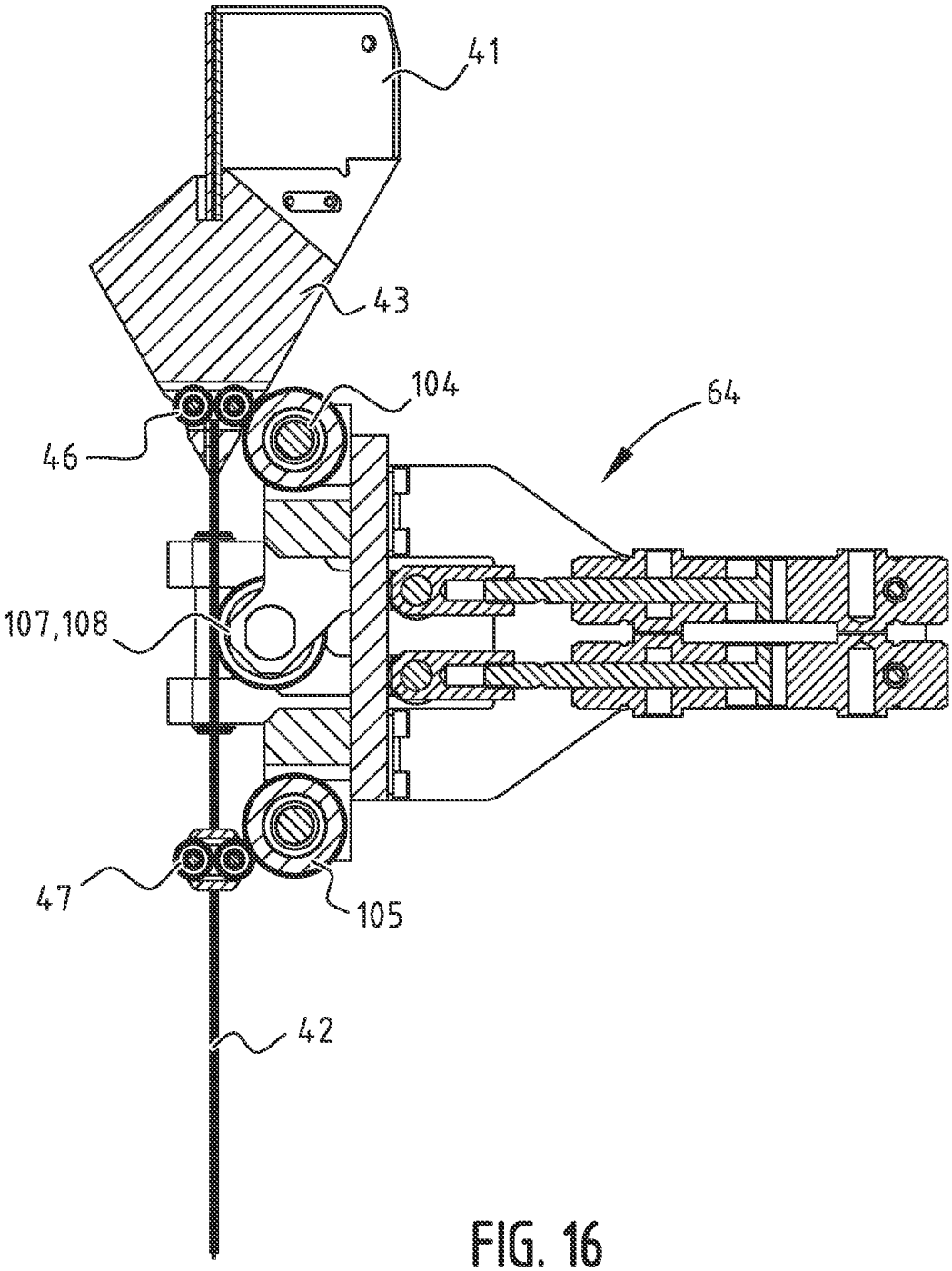
FIG. 16 depicts a cross-sectional view of the guiding element and pressure rollers of FIG. 14.

At least one of the lateral edges 62, 63 of the downstream guiding element part 42 (in the embodiment shown in FIGS. 5-10 both lateral edges 62 and 63) has an opening 48, 49 arranged to receive the pressure rollers (for instance the rollers 90, 91 of fold arranging system 60 of FIG. 12 and pressure rollers 107, 108 of FIG. 13) for pressing on the strip of tubular shrink foil material to provide the at least one additional fold in the tubular shrink foil material. More specifically, a first pair of pressure rollers is arranged at the left opening 48 and a second pair of pressure rollers is arranged at the right opening 49 of the guiding element. Either of the first and second pair of pressure rollers comprises a first roller arranged facing the back side of the downstream guiding element part 42 and a second roller arranged facing the front side of the downstream guiding element part 42. The distance between the first and second roller of each pair of pressure rollers is small enough to force the creation of a (semi-)permanent local fold in the flattened tubular foil material (S) by pressing the foil material at the position of the associated lateral edge of the downstream guiding element part 43 and/or to force the removal of an existing fold in the flattened tubular foil material at more laterally inward positions (if such preformed foil is actually present). The pressure rollers may be passive rollers (for instance passive wheels), which means that they are not driven, although exemplary embodiments with driven rollers may be possible as well.

Figure 10:
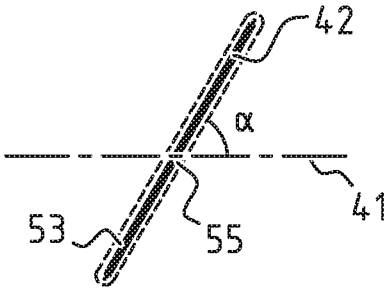
FIG. 10 depicts a cross-sectional view of the guiding element of FIG. 6, taken along line X of FIG. 6.
Figure 11:
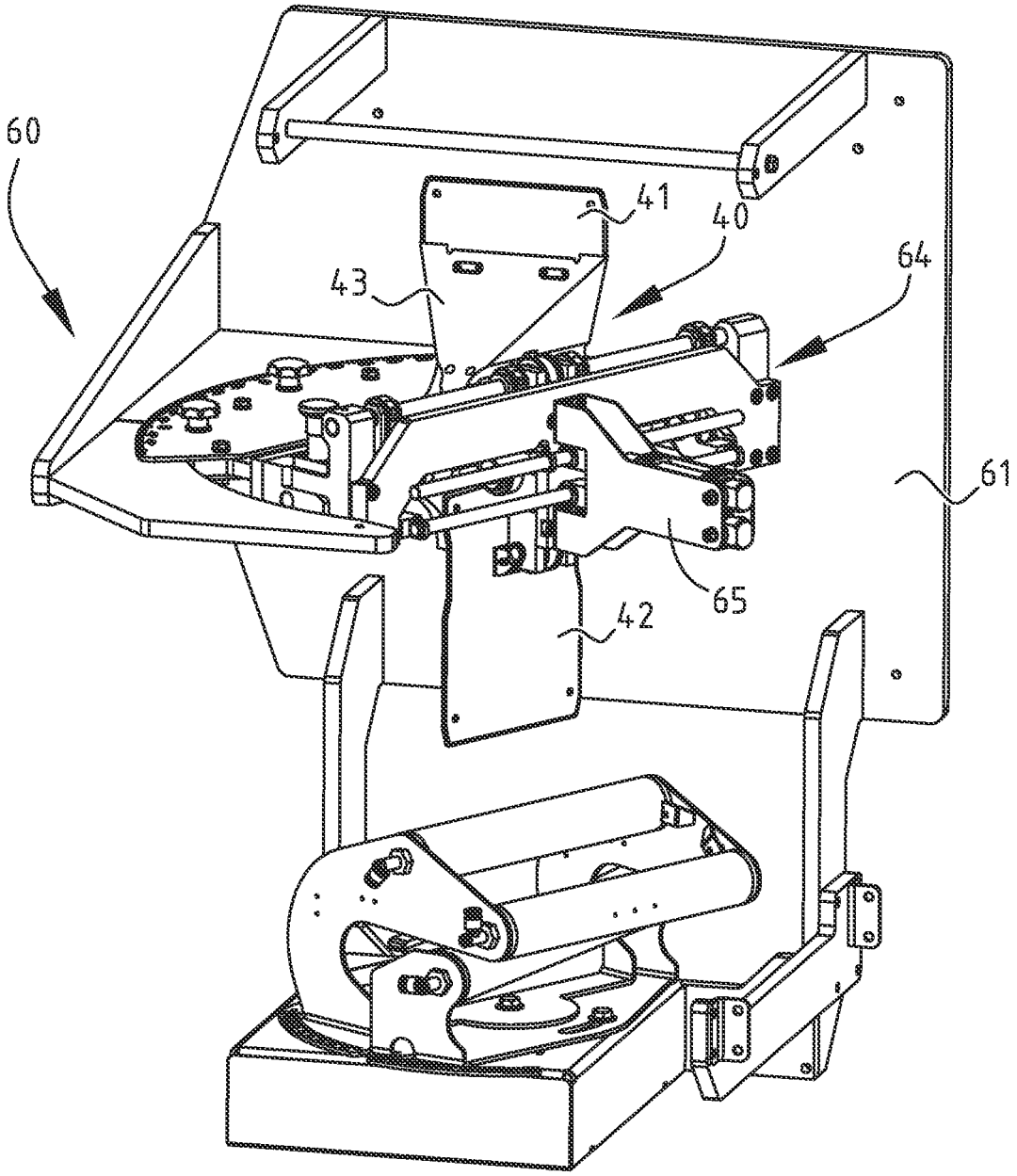
FIG. 11 depicts a front perspective view of a fold arranging system in a closed position comprising a fold arranging device for use with the guiding element of FIG. 6.

The position of the additional folds is determined by the orientation of the first plane (i.e. the orientation of the upstream guiding element part 41) with respect to the second plane (i.e. the orientation of the downstream guiding element part 42). In FIG. 10 the orientation of the second plane (downstream guiding element part 42) relative to the orientation of the first plane (upstream guiding element part 41, denoted by a dotted line) is shown. The position of the folds and 3, 3' and thereby the cross-sectional shape of the strip 4 of foil material downstream of the guiding element 40 depends on the angle ($\alpha$) between the first and second plane. If the angle is 90 degrees, the tubular strip 4 will have a generally square shape. If the angle is smaller (or larger) the shape will be rectangular. By selecting a guiding element having a suitable angle ($\alpha$) from a number of preformed guiding elements having guiding element parts at different angles a suitable shape of the strip 4 of foil material may be provided, i.e. a shape adapted to the shape of the container to be sleeved.

In exemplary embodiments of the present disclosure the guiding element is shaped in such a manner that a strip of tubular foil material is able to travel smoothly from the upstream guiding element part 41 towards the downstream guiding element part 42 and further without encountering any substantial disturbances that may cause wrinkles, creases, unwanted folds, etc. To this end the circumference 51 (cf. FIG. 6, the circumference in cross-section, i.e. in a plane perpendicular to the imaginary central longitudinal axis 55) of the upstream guiding element 41 is essentially the same as the circumference 53 of the downstream element 42 and the circumference 52 of the intermediate guiding element 43. The circumference in cross-section may be constant over the entire height of the guiding element so that a smooth transport of the strip of foil material can be provided.

Alternatively or additionally the guiding element is shaped so that the travel paths of the strip of flattened tubular shrink foil material travelling in downstream direction over the outer surfaces of the guiding element are equal at all positions along the circumference of the guiding element. Preferably the guiding element is shaped in such a manner that the circumference remains constant over the height of the guiding element while the lengths of the travel paths over the entire circumference are equal as well. In this manner a particularly smooth travel behavior is created, which means that the risk of disturbances while traveling along the guiding element is further reduced.

The guiding element may furthermore be shaped so that the outer surfaces of the upstream guiding element part are essentially flush with the outer surfaces of the intermediate guiding element part and/or so that the outer surfaces of the intermediate guiding element part are essentially flush with the outer surfaces of the downstream guiding element part. By making the guiding element parts flush relative to each other there is essentially no disturbance at the transition between the upper guiding element part and the intermediate guiding element part and at the transition between the intermediate guiding element part and the downstream guiding element part.

FIGS. 11-16 show different views in perspective of an exemplary embodiment of a fold arranging system 60 comprising a fold arranging device 22 of the container sleeving system 5 of FIG. 4. The fold arranging device 22 comprises a stationary frame 61 connected to or separate from stationary frame 20 of the sleeving device 10. Attached to the frame 61 is a roller support 65 configured to support a set of drive rollers 104, 105 arranged to (indirectly) engage the positioning rollers 46, 47 and a set of pressure rollers 90, 91, 107, 108 configured to press against the foil material transported along the rollers so as to create new folds and/or remove existing folds. The roller support 65 is rotatably mounted to the frame 61 so that the orientation of the roller support 65 relative to the frame 61 can be varied. The angle between the roller support 65 and the frame 61 can be determined from a scale 86 provided at the outer circumferential edge of the support 65. The support 65 can be fixed at the right angle by operation of fixing means 87 provided on the support 65 (FIG. 12).

The support 65 comprises a yoke comprised of a first yoke member 80 and a second yoke member 82 rotatably mounted to the first yoke member 80 through a hinge element 83. The first yoke member 80 is configured to support pressure rollers 107, 108 and drive rollers 104, 105 while the second yoke member 81 supports the pressure rollers 90, 91. The drive rollers 104, 105 are further configured to carry the guiding element 40.

The guiding element can therefore be removably attached to the frame 61.

This makes the guiding element easily replaceable so that the position of the fold in the tubular foil material can be easily set by selecting an appropriate guiding element and attaching the same to the frame 61.

The rollers are carried on respective shafts 100-102 that enable the lateral position of at least one of the rollers to be adapted (movement in direction 120 possible, see FIG. 15), for instance for adapting to different guiding elements and/or for changing the positions at which additional folds are to be created and/or existing folds are to be removed. The pressure rollers may be pressed towards each other (i.e. the front side pressure rollers 107 and 108 in the direction of the back side pressure rollers 90 and 90, respectively. The pressing action can be accomplished by a number of actuators 110, 111. The shown construction enables the pressure rollers for creating a fold to be pressed with a different pressing force than the pressure rollers that are aimed at removing a fold.

At the downstream end of the fold arranging system 60 a foil material orientation unit 69 is provided. The foil material orientation unit 69 comprises two guiding roller supports 70, 71 that are rotatably mounted to the frame 61. Each of the guiding roller support 70, 71 can be individually rotated to a suitable position. The angle depends on the shape of the guiding element 40, more specifically to the orientation of the upstream guiding element part 41 receiving the strip of foil material to be folded and the orientation of the downstream guiding element part 42 receiving the strip of foil material that has been folded. The guiding roller 73 of guiding roller support 71 is orientated in such a way by rotation of the guiding roller support 71 that the orientation corresponds to the orientation of the downstream guiding element part 42. The guiding roller 74 of guiding roller support 70 is orientated in such a way by rotation of the guiding roller support 70 that the orientation corresponds to the orientation of the upstream guiding element part 41. However, different orientations are also possible. The angles at which the respective guiding support supports 70, 71 extend relative to the frame 61 can be derived from respective scales 75 and 76.

Although the present disclosure has been described with exemplary embodiments, various changes and modifications may be suggested to one skilled in the art. It is intended that the present disclosure encompass such changes and modifications as fall within the scope of the appended claims.

I claim:

1. A system for arranging at least one additional fold in a strip of flattened tubular shrink foil material, the system comprising:

(a) a guiding element having a front side and a back side and configured to guide therealong the strip of flattened tubular shrink foil material in an axial direction along the guiding element, wherein the guiding element comprises:

(i) an upstream guiding element formed by a first flat plate extending in a first plane, (ii) a downstream guiding element formed by a second flat plate extending in a second plane rotated with respect to the first plane, (iii) a generally wedge-shaped intermediate guiding element connected to or integrally formed with the upstream and downstream guiding elements and shaped so as to smoothly guide the flattened tubular shrink foil material moving over the first flat plate towards the second flat plate, (iv) a first set of positioning rollers provided in a transversal groove located in an outer surface of the intermediate guiding element, and (v) a second set of positioning provided in an outer surface of the downstream guiding element;

(b) at least one pair of pressure rollers arranged on either side of the downstream guiding element and configured to press at least one additional fold into the tubular shrink foil material; and (c) a drive unit to move the strip in an axial direction along the guiding element, wherein the drive unit comprises a frame and a roller support rotatably attached to the frame such that the orientation of the roller support is configured to be set relative to the frame depending on the orientation of the downstream guiding element, wherein the roller support comprises a first support member and a second support member pivotable relative to the first support member between an open position and a closed position, wherein the guiding element is positioned between the first support member and the second support member such that the guiding element is removable from the frame when the first support member and the second support member are in the open position.

2. The system of claim 1, further comprising a foil supply for supplying flattened tubular shrink foil material to the system;

a spreading unit configured to receive the flattened tubular shrink foil material in which at least one additional fold has been arranged and spreading open the tubular shrink foil material; and a discharge unit for moving the flattened tubular shrink foil material along the spreading unit and discharging the flattened tubular shrink foil material towards one or more containers on the conveyor.

3. The system as claimed in claim 2, comprising a cutting unit for cutting the strip of foil material into sleeves of predetermined length.

4. The system of claim 1 further comprising a foil material orientation unit downstream of the device, wherein the foil material orientation unit comprises a pair of guiding roller supports that are rotatably mounted to the frame such that each guiding roller support of the pair of guiding roller supports are individually rotatable relative to the frame, wherein a first guiding roller support of the pair of guiding roller supports is oriented to correspond to an orientation of the upstream guiding element, wherein a second guiding roller support of the pair of guiding roller supports is oriented to correspond to an orientation of the downstream guiding element.

* * * * *